US008323426B2

(12) United States Patent
Danielou et al.

(10) Patent No.: US 8,323,426 B2
(45) Date of Patent: Dec. 4, 2012

(54) AL-LI ROLLED PRODUCT FOR AEROSPACE APPLICATIONS

(75) Inventors: Armelle Danielou, Les Echelles (FR); Jean Christophe Ehrstrom, Echirolles (FR)

(73) Assignee: Constellium France, Courbevoie (FR)

( * ) Notice: Subject to any disclaimer, the term of this patent is extended or adjusted under 35 U.S.C. 154(b) by 0 days.

(21) Appl. No.: 12/752,786

(22) Filed: Apr. 1, 2010

(65) Prior Publication Data

US 2010/0314007 A1 Dec. 16, 2010

Related U.S. Application Data

(62) Division of application No. 12/339,611, filed on Dec. 19, 2008, now abandoned.

(60) Provisional application No. 61/020,038, filed on Jan. 9, 2008.

(30) Foreign Application Priority Data

Dec. 21, 2007 (FR) ..... 07 09069

(51) Int. Cl.
*C21D 11/00* (2006.01)

(52) U.S. Cl. ..... 148/502; 148/552; 148/694

(58) Field of Classification Search ..... 148/437–440, 148/502, 691–694, 549–552; 420/531–533, 420/539–543, 528–529, 552–553
See application file for complete search history.

(56) References Cited

U.S. PATENT DOCUMENTS 4,999,061 A 3/1991 Curtis
(Continued)

FOREIGN PATENT DOCUMENTS

EP 1359232 A 11/2003
(Continued)

OTHER PUBLICATIONS

Reyholds et al., "The Effect of Thermal Exposure on the Fracture Behavior of Aluminum Alloys Intended for Elevated Temperature Service," ASTM Special Technical Publication, American Society for Testing Materials, vol. STP 1297, 1997, pp. 191-205.

(Continued)

*Primary Examiner* — Stanley Silverman
*Assistant Examiner* — Brian Walck
(74) *Attorney, Agent, or Firm* — Baker Donelson Bearman Caldwell & Berkowitz, PC

(57) ABSTRACT

The present invention is directed to a substantially unrecrystallized rolled aluminum alloy product, obtained from a plate with a thickness of at least 30 mm, comprising 2.2 to 3.9 wt. % Cu, 0.7 to 2.1 wt. % Li, 0.2 to 0.8 wt. % Mg, 0.2 to 0.5 wt. % Mn, 0.04 to 0.18 wt. % Zr, less than 0.05 wt. % Zn, and optionally 0.1 to 0.5 wt. % Ag, remainder aluminum and unavoidable impurities having a low propensity to crack branching during L-S a fatigue test. A product of the invention has a crack deviation angle Θ of at least 20° under a maximum equivalent stress intensity factor Keff max of 10 MPa √m for a S-L cracked test sample under a mixed mode I and mode II loading wherein the angle Ψ between a plane perpendicular to the initial crack direction and the load direction is 75°.

17 Claims, 8 Drawing Sheets

U.S. PATENT DOCUMENTS

| | | | | |
|---|---|---|---|---|
| 5,393,357 | A * | 2/1995 | Cho | 148/437 |
| 2004/0071586 | A1 | 4/2004 | Rioja et al. | |
| 2004/0182483 | A1 | 9/2004 | Heymes et al. | |
| 2005/0006008 | A1 * | 1/2005 | Cho | 148/439 |

FOREIGN PATENT DOCUMENTS

| | | | |
|---|---|---|---|
| JP | 03107440 | A | 5/1991 |
| WO | 2004106570 | A | 12/2004 |

OTHER PUBLICATIONS

Balmuth et al., "Fracture and fatigue crack growth resistance of recrystallized Al-Li Alloys," Materials Science Forum, vol. 217-222, No. 3, 1996, pp. 1365-1370.

IR7026 Rapport de Recherche Preliminaire, Apr. 11, 2008.

* cited by examiner

AL-LI ROLLED PRODUCT FOR AEROSPACE APPLICATIONS

CROSS REFERENCE TO RELATED APPLICATIONS

This application is a divisional application of 12/339,611 filed Dec. 19, 2008, which claims priority to the U.S. provisional application 61/020,038 filed Jan. 9, 2008, which claims priority to French Application 0709069 filed Dec. 21, 2007.

BACKGROUND OF THE INVENTION

1. Field of the Invention

The present invention relates generally to aluminum-lithium alloys, and in particular, to such alloys useful in the aerospace industry.

2. Description of Related Art

Aluminum-lithium alloys have long been recognized as an effective solution to reduce weight of structural elements because of the low density of these alloys. However, the different requirements of the aircraft industry materials such as, having a high Young modulus, high compression resistance, high damage tolerance and high corrosion resistance, have proven difficult to be obtained simultaneously. Al—Li alloys are particularly sensitive to crack turning or crack deflection, which is among the problems related to damage tolerance limiting their use. (Hurtado, J A; de los Rios, E R; Morris, A. J, <<Crack deflection in Al—Li alloys for aircraft structures", 18th Symposium of the International Committee on Aeronautical Fatigue, Melbourne; UNITED KINGDOM; 3-5 May 1995. pp. 107-136. 1995).

Crack deviation, crack turning or also crack branching are terms used to express propensity for crack propagation to deviate from the expected fracture plane perpendicular to the loading direction during a fatigue or toughness test. Crack deviation happens on a microscopic scale (<100 μm), on a mesoscopic scale (100-1000 μm) or on a macroscopic scale (>1 mm) but it is considered detrimental only if the crack direction remains stable after deviation (macroscopic scale). The phenomenon is a particular concern for fatigue trials in L-S direction for aluminum-lithium alloys. The term crack branching is used herein for macroscopic deviation of cracks in L-S fatigue or toughness tests from the S direction towards the L direction which occurs for rolled products with a thickness of 30 mm or higher. Crack branching may occur in relation to the rolled product composition and microstructure and to the test conditions. Rolled products made of AA7050 can be considered as a reference of products having a low propensity to crack branching.

Crack branching has been considered as a major problem by aircraft manufacturers because it is difficult to take into account to dimension parts, thereby making impossible the use of traditional design methods. Thus, crack branching invalidates conventional, mode I based, materials testing procedure and design models. The crack branching problem has proven difficult to solve. Recently it was considered that in the absence of solution for avoiding crack branching, efforts should be directed to predicting crack branching behaviors. (M. J. Crill, D. J. Chellman, E. S. Balmuth, M. Philbrook, K. P. Smith, A. Cho, M. Niedzinski, R. Muzzolini and J. Feiger, Evaluation of AA 2050-T87 Al—Li Alloy Crack Turning Behavior, Materials Science Forum, Vol 519-521 (July 2006) pp 1323-1328).

There is a need for an aluminum lithium alloy rolled product for aircraft applications and in particular for integrally machined parts, which has a low propensity to crack branching.

SUMMARY OF THE INVENTION

For these and other reasons, the present inventors arrived at the present invention directed to an aluminum copper, lithium alloy rolled product, that has a low propensity to crack branching and exhibits high strength, high toughness and high corrosion resistance.

In accordance with these and other objects, the present invention is directed to a substantially unrecrystallized rolled aluminum alloy plate with a thickness of at least 30 mm, comprising 2.2 to 3.9 wt. % Cu, 0.7 to 2.1 wt. % Li, 0.2 to 0.8 wt. % Mg, 0.2 to 0.5 wt. % Mn, 0.04 to 0.18 wt. % Zr, less than 0.05 wt. % Zn, and optionally 0.1 to 0.5 wt. % Ag, remainder aluminum and unavoidable impurities. A plate of the present invention generally has a crack deviation angle Θ of at least 20° under a maximum equivalent stress intensity factor $K_{eff\ max}$ of 10 MPa √m for a S-L cracked test sample under a mixed mode I and mode II loading wherein the angle Ψ between a plane perpendicular to the initial crack direction and the load direction is 75°.

Another object of the invention is directed to a method for producing a substantially unrecrystallized aluminum alloy plate with a thickness of at least 30 mm having a low propensity to crack branching. A suitable method according the present invention comprises:

a) casting an ingot comprising 2.2 to 3.9 wt. % Cu, 0.7 to 2.1 wt. % Li, 0.2 to 0.8 wt. % Mg, 0.2 to 0.5 wt. % Mn, 0.04 to 0.18 wt. % Zr, less than 0.05 wt. % Zn, and optionally 0.1 to 0.5 wt. % Ag, remainder aluminum and unavoidable impurities,
b) homogenizing the ingot at 470-510° C. for a duration from 2 to 30 hours,
c) hot rolling the ingot with an exit temperature of at least 410° C. to a plate with a final thickness of at least 30 mm,
d) solution heat treating by soaking at 490 to 540° C. for 15 min to 4 h, wherein the total equivalent time of homogenization and solution heat treatment t(eq)

$$t(eq) = \frac{\int \exp(-26100/T)dt}{\exp(-26100/T_{ref})}$$

does not exceed 30 h and preferably 20 h, where T (in Kelvin) is the instantaneous temperature of treatment, which evolves with the time t (in hours), and $T_{ref}$ is a reference temperature set at 773 K, e) cold water quenching,
f) stretching the plate with a permanent set from 2 to 5%,
g) aging the plate by heating at 130-160° C. for 5 to 60 hours.

Yet another object of the invention is a structural member formed of a plate according to the present invention. Additional objects, features and advantages of the invention will be set forth in the description which follows, and in part, will be obvious from the description, or may be learned by practice of the invention. The objects, features and advantages of the invention may be realized and obtained by means of the instrumentalities and combination particularly pointed out in the appended claims.

BRIEF DESCRIPTION OF THE DRAWINGS

The accompanying drawings, which are incorporated in and constitute a part of the specification, illustrate a presently preferred embodiment of the invention, and, together with the general description given above and the detailed description of the preferred embodiment given below, serve to explain the principles of the invention.

FIG. 1 diagrammatically shows the location of the Sinclair sample.

FIG. 2 shows the geometry of the Sinclair sample.

FIG. 3 diagrammatically shows the mixed-mode testing conditions of the Sinclair sample.

FIG. 4 diagrammatically shows the method for determining the deviation angle Θ on a broken Sinclair sample.

FIG. 5 shows the evolution of deviation angle with the maximal equivalent stress intensity factor for two different homogenizing treatment applied on a same alloy and for a reference 7050 plate.

FIG. 6 shows the test sample used for L-S fatigue testing.

FIG. 7 are photographs of samples after L-S fatigue trial test for two different homogenizing treatment applied on a same alloy.

FIG. 8 are photographs of samples of thickness 25 mm or 30 mm after L-S fatigue trial test.

DETAILED DESCRIPTION OF A PREFERRED EMBODIMENT

Unless otherwise indicated, all the indications relating to the chemical composition of the alloys are expressed as a mass percentage by weight based on the total weight of the alloy. The expression 1.4 Cu means that the copper content in weight % is multiplied by 1.4. Alloy designation is in accordance with the regulations of The Aluminium Association, known to those skilled in the art. The definitions of tempers are laid down in European standard EN 515. Definitions according to EN 12258-1 apply unless mentioned otherwise.

Unless mentioned otherwise, static mechanical characteristics, in other words the ultimate tensile strength UTS, the tensile yield stress TYS and the elongation at fracture A, are determined by a tensile test according to standard EN 10002-1, the location at which the pieces are taken and their direction being defined in standard EN 485-1.

The fatigue crack propagation rate (using the da/dN test) is determined according to ASTM E 647. Plane-strain fracture toughness ($K_{1C}$) is determined according to ASTM E 399.

There are three modes of fracture. Mode I, or the opening mode, is characterized by a stress normal to the crack faces. Mode II, the sliding mode or forward shear mode, has a shear stress normal to the crack front. Finally Mode III is the tearing mode, with a shear stress parallel to the crack front.

Figure 1:
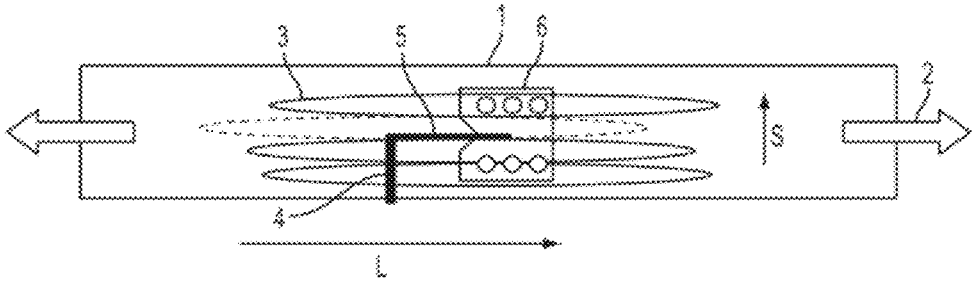
FIGS. 1-8 are directed to certain aspects of the invention as described herein. They are illustrative and not intended as limiting.

The propensity to crack branching is usually observed during a L-S toughness or fatigue test in mode I. A quantitative result is obtained from a mixed-mode crack growth test carried out on a S-L sample. Specimens and test conditions for investigating biaxial fatigue properties have been described by H. A. Richard ("Specimens for investigating biaxial fracture and fatigue properties", Biaxial and Multiaxial Fatigue, EGF 3 (Edited by M. W. Brown and K. J. Miller), 1989, Mechanical Engineering Publications, London pp 217-229). Specimen S9 described by Richard is used herein. The rational for relating propensity to crack-branching in L-S toughness or fatigue tests to deviation angles measured in mixed mode I and mode II loading tests is described by Sinclair and Gregson ("The effects of mixed mode loading on intergranular failure in AA7050-T7651", Materials Science Forum, Vol. 242 (1997) pp 175-180). The objective is to reproduce the local load that occurs at the tip of the crack after crack branching on an L-S sample. FIG. 1 schematically shows crack branching on an L-S sample and the location of the test sample proposed by Sinclair ("the Sinclair sample"). An L-S sample (1) with elongated grains (3) under a load (2) with an initial crack in mode I (4) undergoes crack branching towards the L direction (deviated crack (5)). The Sinclair test sample (6) is an S-L sample and the initial crack will correspond to a 90° deviated crack of an L-S sample. If the crack of "the Sinclair sample" is stable under a mixed mode I and mode II loading representative of the deviated crack loading, then the deviated crack would have been stable and the sample has a high propensity to crack branching. The geometry of "the Sinclair sample" is provided in FIG. 2. 6 holes (61) are used to fix the Sinclair sample to a testing device. The sample is pre-cracked mechanically, the length of the pre-crack is 7 mm.

Figure 3:
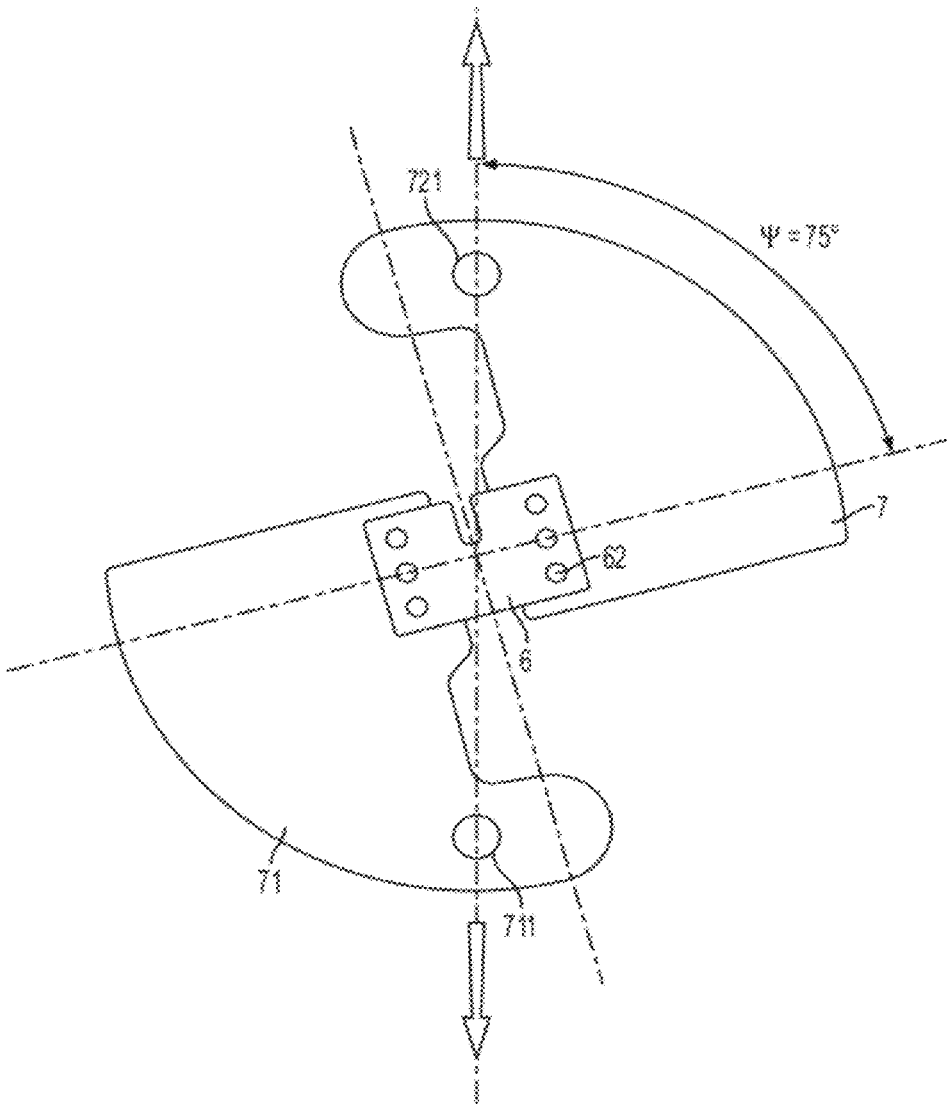

The "Sinclair sample" is loaded under a mixed mode I and mode II according to FIG. 3. Two sample holders (71) and (72) are used to load the sample under mixed mode I and mode II. The sample is fixed to the sample holders with the six holes (61) to form an assembly, which is loaded between the holes (711) and (721). The load application angle Ψ between a plane perpendicular to the initial crack direction and the load direction is 75°.

The stress intensity factors $K_I$ and $K_{II}$ for mode I and mode II are provided by $$K_{I,II} = \frac{P\sqrt{\pi \cdot a}}{Wt} F_{I,II}$$

where P is the load (N), a is the crack length (mm), W is the sample width (mm), t is the sample thickness (mm). For a fatigue test, the maximum load is referred to as $P_{max}$ and the corresponding stress intensity factor is referred to as $K_{max}$.

Form factors $F_I$ and $F_{II}$ for mode I and mode II, respectively, corresponding to the sample geometry are $$F_I = \frac{\cos\Psi}{1-\frac{a}{W}}\sqrt{\frac{0.26+2.65\left(\frac{a}{W-a}\right)}{1+0.55\left(\frac{a}{W-a}\right)-0.08\left(\frac{a}{W-a}\right)^2}}$$

$$F_{II} = \frac{\sin\Psi}{1-\frac{a}{W}}\sqrt{\frac{-0.23+1.40\left(\frac{a}{W-a}\right)}{1-0.67\left(\frac{a}{W-a}\right)+2.08\left(\frac{a}{W-a}\right)^2}}$$

where Ψ is the angle between a plane perpendicular to the initial crack direction and the load direction.

The equivalent stress intensity factor $K_{eff}$ is determined according to $$K_{eff}=\sqrt{((1-\nu^2)K_I^2+(1-\nu^2)K_{II}^2+(1+\nu)K_{III}^2)}$$

For the geometry used in the test $K_{III}=0$. $K_{eff\,max}$ is the maximum equivalent stress intensity factor during a fatigue cycle, it corresponds to the maximum load $P_{max}$.

Figure 4:
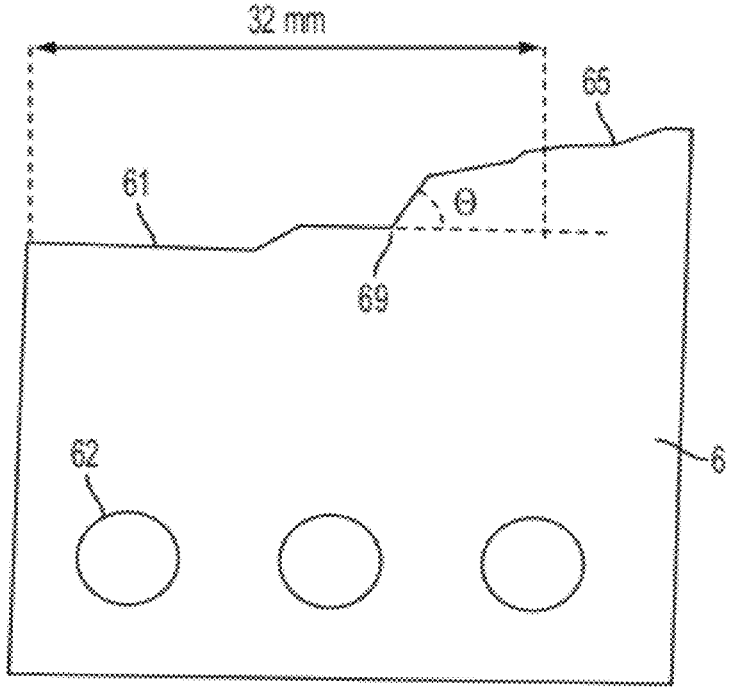

The deviation angle Θ between the initial crack direction and the deviated crack direction enables a quantitative evaluation of the propensity to crack branching. It is measured according to FIG. 4. FIG. 4 is a drawing of a broken Sinclair sample (61). The profile (65) of the broken specimen is measured with a profilometer with steps of 0.5 mm. The resulting data points are smoothed with 3 points moving average. The deviation angle is measured for each set of three data point.

The maximum deviation angle between the tip of the mechanical crack (69) and a distance of 32 mm from the sample edge is the Θ value.

A plot of Θ vs $K_{eff\,max}$ provides a quantitative measurement which can be related to the crack branching propensity for a L-S test sample. For a given $K_{eff\,max}$, greater values of Θ indicates less propensity to crack branching. However, for reasons explained in the above mentioned reference by Sinclair and Gregson, for a $K_{eff\,max}$ value of less than around 5 MPa √m or higher than around 15 MPa √m, the Θ value typically does not discriminate among samples. For this reason, the Θ value is particularly significant for $K_{eff\,max}$=10 MPa √m. According to this invention, a substantially unrecrystallized rolled aluminum alloy product with a thickness of at least 30 mm has a low propensity to crack branching if Θ is maintained at a value of at least about 20° and preferably at least 30° for a $K_{eff\,max}$=10 MPa √m for a "Sinclair sample" under mixed-mode load (Ψ=75°). Sinclair and Gregson clearly show that for a AA7050 test sample, known to exhibit a low propensity to crack branching, the condition on Θ is met.

The term "structural member" refers to a component used in mechanical construction for which the static and/or dynamic mechanical characteristics are of particular importance with respect to structure performance, and for which a structure calculation is usually being prescribed or made. These are typically components the rupture of which may seriously endanger the safety of a mechanical construction, its users or third parties. In the case of an aircraft, structural members can comprise members of the fuselage (such as fuselage skin), stringers, bulkheads, circumferential frames, wing components (such as wing skin, stringers or stiffeners, ribs, spars), empennage (such as horizontal and vertical stabilisers), floor beams, seat tracks, doors.

A substantially unrecrystallized rolled aluminum alloy product with a thickness of at least 30 mm according to the present invention has a low propensity to crack branching because of the combination of a carefully selected composition which has been treated by specific process steps.

An aluminum lithium alloy rolled product of the invention comprises 2.2 to 3.9 wt. % Cu, 0.7 to 2.1 wt. % Li, 0.2 to 0.8 wt. % Mg, 0.2 to 0.5 wt. % Mn, 0.04 to 0.18 wt. % Zr and less than 0.05 wt. % Zn, optionally 0.1 to 0.5 wt. % Ag, remainder aluminum and unavoidable impurities. Preferably, the Si and Fe content is at most 0.15 wt. % each, more preferably 0.10 wt. % and other unavoidable impurities content is at most 0.05 wt. % each and 0.15 wt. % total. Preferentially, a refining agent comprising titanium is added during casting. Titanium content is preferentially comprised from 0.01 to 0.15 wt. % and preferably from 0.01 to 0.04 wt. %. Copper content is preferably at least 2.7 wt. % or even 3.2 wt. %. The copper content can be variously selected in order to achieve the desired strength characteristics. Lithium content is preferably at least 0.8 wt. %, or even more preferably at least 0.9 wt. %. The lithium content can be varied as needed in order to obtain the desired density characteristics. In some embodiments, the maximum lithium content is not more than 1.8 wt. % or even not more than 1.4 wt. %, and preferentially in some cases, not more than about 1.25 wt. %. The present invention is particularly advantageous for alloys which simultaneously comprise a high Li and a high Cu content, because these types of alloys exhibit a very favorable mechanical property balance, but are particularly sensitive to crack branching. In a preferred embodiment, the Li and Cu content expressed in weight percent follow Li+Cu>4 and preferably Li+Cu>4.3. However, if the alloy simultaneously comprises a very high Li and Cu content, incipient melting may occur during homogenization. In a preferred embodiment, the Li and Cu content expressed in weight percent follow Li+0.7 Cu<4.3 and preferentially Li+0.5 Cu<3.3.

Manganese is a particularly desirable component of a rolled product of the invention and the content thereof is carefully selected, preferably between 0.3 and 0.5 wt. %. A carefully controlled distribution of manganese dispersoïds obtained through a selected content combined with specific thermo-mechanical treatment contributes to avoid stress localization and stress at grain boundaries. Although they are not bound to any specific theory, the inventors believe that the distribution of manganese containing dispersoids obtained according to the present invention contributes to the low propensity to crack branching.

Performances in strength and toughness observed by the inventors are usually difficult to reach for silver free alloys, in particular when the permanent elongation after stretching is less than 3%. The present inventors believe that silver has a role during the formation of copper containing strengthening phases formed during natural or artificial aging and in particular, enables the production of finer phases and also produces a more homogeneous distribution of these phases. An advantageous effect of silver is observed when the silver content is at least 0.1 wt. % and preferentially at least 0.2 wt. %. Excessive addition of Ag would likely be economically prohibitive in many cases due to silver's high cost, and it is thus advantageous not to exceed 0.5 wt. % or even 0.3 wt. %.

Addition of Mg improves strength and reduces density. Excessive addition of Mg may however adversely affect toughness. In an advantageous embodiment, the Mg content is not more than 0.4 wt. %. The present inventors believe that Mg addition may also have role during the formation of copper containing phases.

An alloy with controlled amounts of alloying elements is cast as an ingot. The ingot is then homogenized at 470-510° C. for 2 to 30 hours and preferably for 4 to 15 hours. A homogenization temperature of at least 470° C. or preferably of at least 490° C. enables simultaneously to form dispersoids and to prepare for an efficient solution heat treatment. The present inventors observed that homogenization temperatures higher than about 510° C. result in a higher propensity to crack branching. It is believed by the present inventors that homogenization temperature affects Mn containing dispersoids size and distribution.

Hot rolling is carried out, after reheating if necessary, to produce plates with a thickness of at least 30 mm. A hot-rolling exit temperature of at least 410° C., preferentially 430° C. or even more preferentially 450° C. is generally necessary in order to obtain a substantially unrecrystallized product after solution heat treatment. By substantially unrecrystallized product it is meant that the recrystallization rate is not more than 10% (or not more than about 10%) at ¼ and ½ thickness (T/4 and T/2). The plates are then solution heat treated by soaking at 490 to 540° C. for 15 min to 4 h and quenched with cold water. Suitable solution heat treatment conditions typically depend on product thickness. It is important to avoid dispersoid coarsening during solution heat treatment as this would jeopardize the effect obtained with the carefully controlled homogenization treatment. Thus, the total equivalent time at 500° C. of homogenization and solution heat treatment advantageously does not exceed about 30 h and preferably does not exceed 20 h.

The equivalent time t(eq) at 500° C. is defined by the formula:

$$t(eq) = \frac{\int \exp(-26100/T)dt}{\exp(-26100/T_{ref})}$$

where T is the instantaneous temperature in Kelvin of treatment which evolves with the time t (in hours) and $T_{ref}$ is a reference temperature selected at 500° C. (773 K). t(eq) is expressed in hours. The constant Q/R=26100 K is derived from the diffusion activation energy for Mn, Q=217000 J/mol. The formula providing t(eq) takes into account the heating and cooling steps. Cold water quenching is carried out after solution heat treatment. In an advantageous embodiment, a rapid quench is carried out. By rapid quench it is meant that the cooling rate is the highest cooling rate made possible in relation to the plate thickness. In a preferred embodiment, vertical immersion quenching is used, rather than horizontal spray quench. The present inventors observed that products processed with a rapid quench are less prone to crack branching. The present inventors believe that this effect may be related to a more limited grain boundary precipitation.

The product is then preferably stretched from 2 to 5% and preferentially from 3 to 4%. Aging can be carried out at 130-160° C. for 5 to 60 hours which results in a T8 temper. In some instances, and particularly for some preferred compositions, aging is more preferentially carried out at 140-160° C. from 12 to 50 hours. Lower aging temperatures generally favor high fracture toughness.

Figure 2:
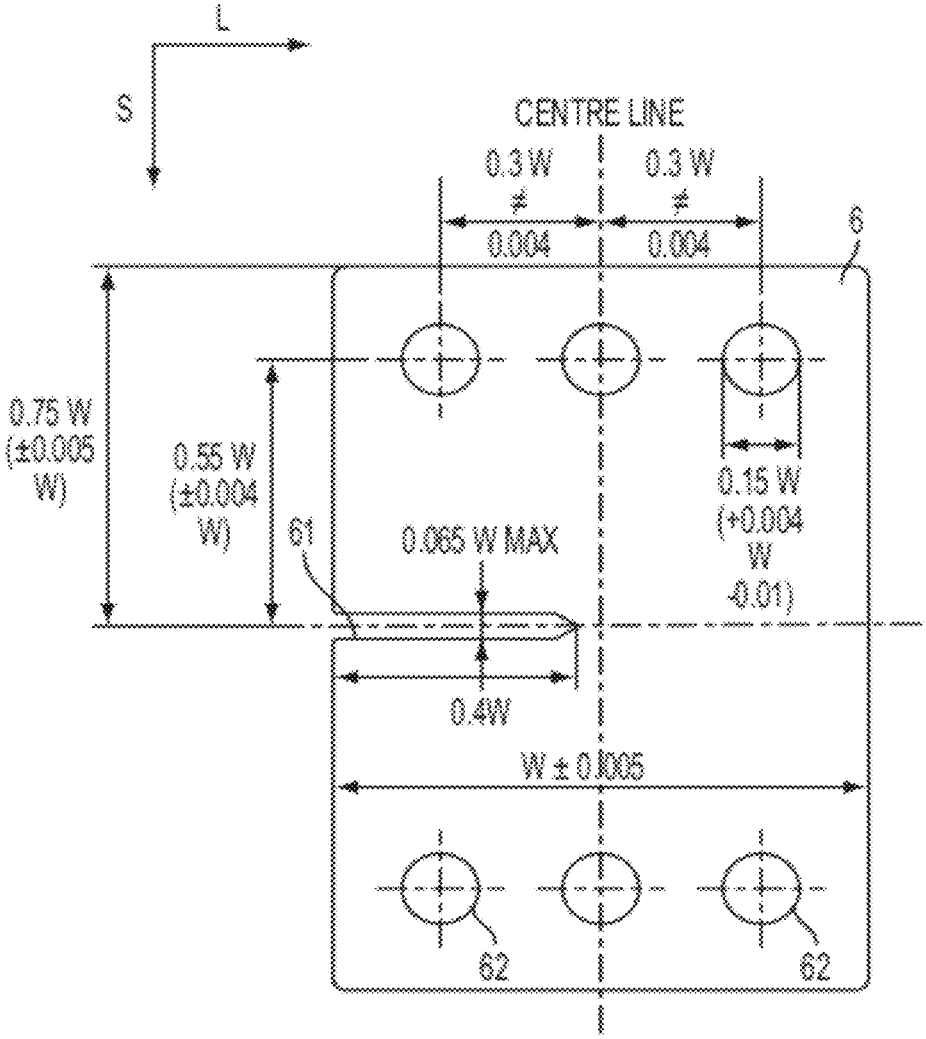

The products of the present invention have a low propensity to crack branching, which means that samples with a thickness of preferably at least 30 mm and preferably of at least 60 mm when tested on a S-L cracked test sample of FIG. 2 under a mixed mode I and mode II loading (..=75° and $K_{eff\ max}$=10 MPa √m) the crack deviation angle Θ is at least 20° and preferentially at least 30°.

Figure 6:
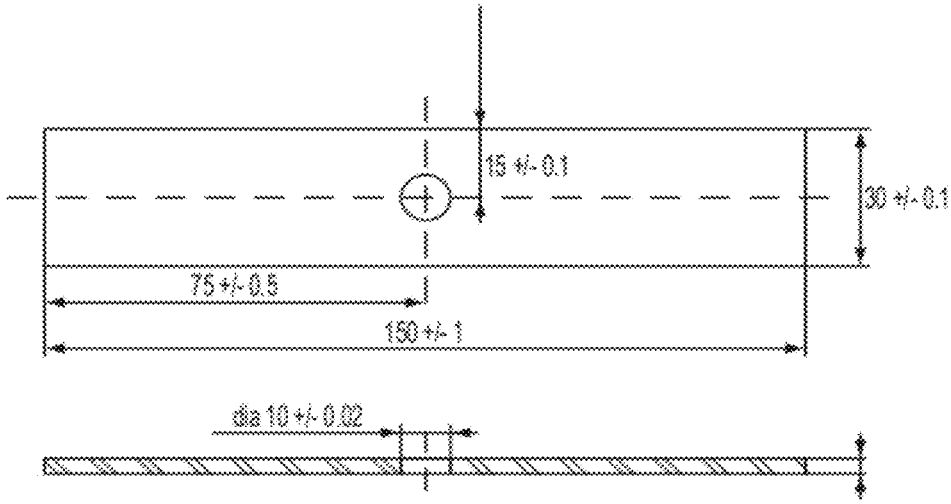

Low propensity to crack branching is also seen on L-S fatigue trials. A low propensity to crack branching also means that products of the present invention exhibit crack branching on not more than about 20% and preferentially not more than 10% L-S test samples after testing at least 4 different samples in a fatigue test according to ASTM E 647 (R=0.1, $\sigma_{max}$=220 MPa), with a test sample according to FIG. 6.

Some other advantageous characteristics of products of the present invention from 30 to 100 mm thick include one or more of a1 and a2 and/or one or more of b1, b2 and b3 in a T8 temper, where:

a1: the tensile yield strength at T/4 and T/2 is at least 455 MPa, preferably 460 MPa or even better 465 MPa in the L-direction.

a2: the ultimate tensile strength at T/4 and T/2 is at least 490 MPa, preferably 495 MPa or even better 500 MPa in the L-direction.

b1: the fracture toughness $K_{1C}$: in L-T direction at T/4 and T/2 is at least 31 MPa√m and preferentially at least 32 MPa√m or even at least 33 MPa√m;

b2: the fracture toughness $K_{1C}$: in T-L direction at T/4 and T/2 is at least 28 MPa√m and preferentially at least 29 MPa√m or even at least 30 MPa√m;

b3: the fracture toughness $K_{1C}$: in S-L direction at T/4 and T/2 is at least 25 MPa√m and preferentially at least 26 MPa√m or even at least 27 MPa√m;

Some other advantageous characteristics of products of the present invention of more than 100 mm include one or more of a4 and a5 and/or one or more of b4, b5 and b6 in a T8 temper:

a4: the tensile yield strength at T/4 and T/2 is at least 440 MPa, preferably at least 445 MPa or even at least 450 MPa in the L-direction a5: the ultimate tensile strength at T/4 and T/2 is at least 475 MPa, preferably at least 480 MPa or even at least 485 MPa in the L-direction b4: the fracture toughness $K_{1C}$: in L-T direction at T/4 and T/2 is at least 26 MPa√m and preferably at least 27 MPa√m or even at least 28 MPa√m;

b5: the fracture toughness $K_{1C}$: in T-L direction at T/4 and T/2 is at least 25 MPa√m and preferably at least 26 MPa√m or even at least 27 MPa√m;

b6: the fracture toughness $K_{1C}$: in S-L direction at T/4 and T/2 is at least 24 MPa√m and preferably at least 25 MPa√m or even at least 26 MPa√m.

A product according to the present invention typically exhibits a high corrosion resistance. When tested under a MASTMAASIS (Modified ASTM Acetic Acid Salt Intermittent Spray) according to ASTM G85 standard, products of the invention can be capable of reaching the EA rating and preferably the P (pitting only) rating. When tested for resistance to SCC (Stress Corrosion Cracking) according to ASTM G47, products of the invention are capable of reaching more than 30 days for ST samples under a 300 MPa constant strain and preferably under a 350 MPa constant strain.

Products of the invention can advantageously be comprised in structural members. A structural member formed of a plate according to the present invention can include for example, spars, ribs and/or frames suitable for aircraft construction. The present invention is particularly suitable for parts with a complex shape made by integral machining a plate, and may be used in particular for aircraft wing construction as well as any other use where the instant properties could be advantageous.

EXAMPLES

Example 1

Two AA2050 ingots, reference A and B were cast. Their composition is provided in Table 1. For comparison purposes, a AA7050 plate in the T7451 temper was also tested for crack branching. The composition is also provided in Table 1.

TABLE 1

Composition (weight %) the different ingots.

| | Si | Fe | Cu | Mn | Mg | Ti | Zr | Li | Ag | Zn |
|---|---|---|---|---|---|---|---|---|---|---|
| A | 0.03 | 0.04 | 3.46 | 0.39 | 0.4 | 0.02 | 0.10 | 0.88 | 0.39 | 0.02 |
| B | 0.04 | 0.05 | 3.60 | 0.39 | 0.4 | 0.02 | 0.09 | 0.91 | 0.37 | 0.02 |
| 7050 | 0.04 | 0.09 | 2.11 | 0.01 | 2.22 | 0.02 | 0.11 | — | — | 6.18 |

Ingot A was homogenized 12 hours at 505° C. (heating rate: 15° C./h, equivalent time at 500° C.: 16.7 h), according to the invention. Ingot B (reference) was homogenized 8 hours at 500° C. followed by 36 hours at 530° C. (heating rate: 15° C./h, equivalent time at 500° C.: 140 h). Ingot A was hot rolled to a 60 mm thick plate and the hot rolling exit temperature was 466° C., the resulting plate was solution heat treated for 2 h at 504° C. (heating rate: 50° C./h, equivalent time at 500° C.: 2.9 h) and cold water quenched. Ingot B was hot rolled to a 65 mm thick plate and the hot rolling exit temperature was 494° C., the resulting plate was solution heat treated for 2 h at 526° C. (heating rate: 50° C./h, equivalent time at 500° C.:6 h) and cold water quenched. Both plates were stretched with a permanent elongation of 3.5% and aged 18 hours at 155° C. The plates resulting from ingot A and ingot B are referred to as plate A-60 and plate B-60, respectively. Total equivalent time at 773 K of homogenization and solution heat treatment t(eq) was thus 19.6 h and 146 h for plates A-60 and B-60, respectively.

The samples were mechanically tested to determine their static mechanical properties as well as their toughness. Tensile yield strength (TYS), ultimate tensile strength (UTS), elongation at fracture (e %) are provided in Table 2 and K1C in Table 3.

TABLE 2

| Tensile properties | | | | | | | | | | | | |
|---|---|---|---|---|---|---|---|---|---|---|---|---|
| | T/4 | | | | | | T/2 | | | | | |
| | L | | | LT | | | L | | | LT | | |
| Sample | UTS MPa | TYS MPa | e (%) | UTS MPa | TYS MPa | e (%) | UTS MPa | TYS MPa | e (%) | UTS MPa | TYS MPa | e (%) |
| Plate A-60 | 511 | 484 | 13 | 511 | 464 | 10 | 518 | 477 | 10 | 481 | 441 | 13 |
| Plate B-60 | 531 | 500 | 11.2 | 521 | 474 | 8.8 | 531 | 489 | 8.1 | 490 | 449 | 10.9 |

TABLE 3

| Toughness properties | | | | | |
|---|---|---|---|---|---|
| | K1c MPa√m) | | | | |
| | T/4 | | T/2 | | |
| Sample | L-T | T-L | L-T | T-L | S-L |
| Plate A-60 | 44.6 | 36.7 | 51.0 | 39.8 | 33.2 |
| Plate B-60 | 42.5 | 36.7 | 40.4 | 40.8 | 33.4 |

Figure 5:
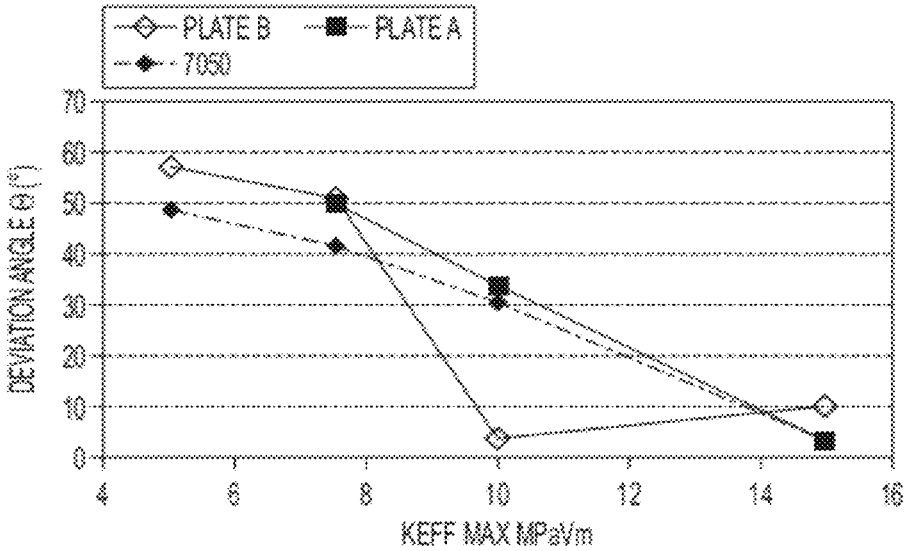

"Sinclair samples" described in FIGS. 1 and 2 and having a width, W=40 mm, and a thickness of 5 mm, were taken from plates A-60 and B-60 at T/2 and tested in fatigue (R=0.1). The test geometry described in FIG. 3 was used. The fatigue tests were carried out for several $K_{eff\,max}$ and the deviation angle Θ was measured on the broken specimens according to the method of FIG. 4. The results are presented in FIG. 5 and table 4.

TABLE 4

| Deviation angle Θ measured after S-L fatigue trial under mixed mode I and II load. | | | | | | | | | |
|---|---|---|---|---|---|---|---|---|---|
| | Plate A-60 | | | Plate B-60 | | | 7050 | | |
| Keff max (MPa √m) | Load (N) | Number of cycles | Θ (°) | Load (N) | Number of cycles | Θ (°) | Load (N) | Number of cycles | Θ (°) |
| 5 | | | | 2221 | 800700 | 57 | 2216 | 900 000 | 49 |
| 7.5 | 3364 | 336500 | 50* | 3351 | 297600 | 51 | 3317 | 240 000 | 42 |
| 10 | 4457 | 102300 | 34 | 4468 | 44500 | 4 | 4423 | 71 500 | 31 |
| 15 | 6715 | 3400 | 4 | 6662 | 2300 | 11 | 6648 | 1 700 | 4 |

*failure occurred within the grips

Figure 7A:
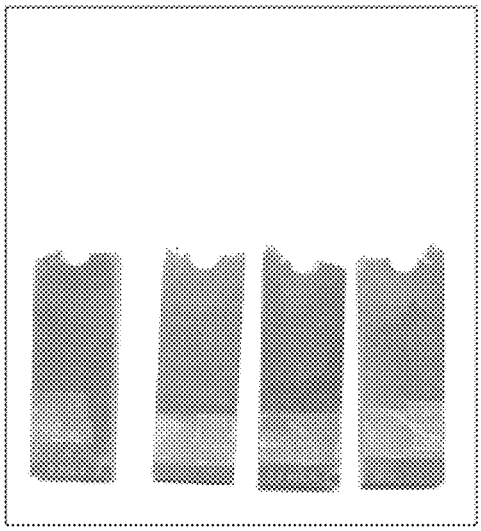
Figure 7B:
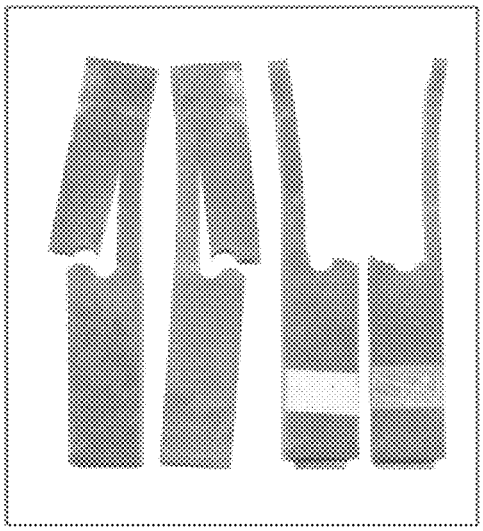
Figure 8A:
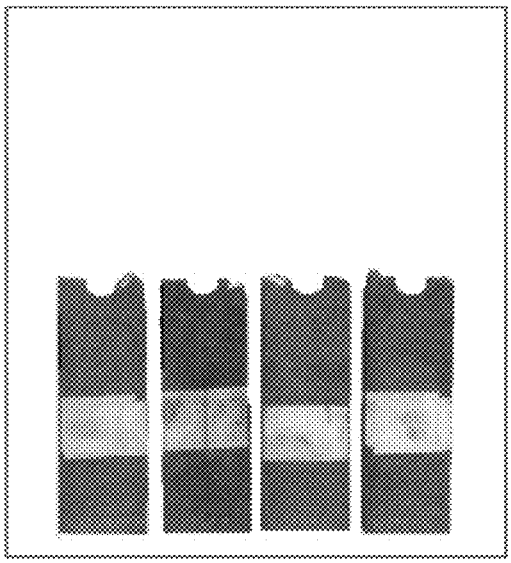
Figure 8B:
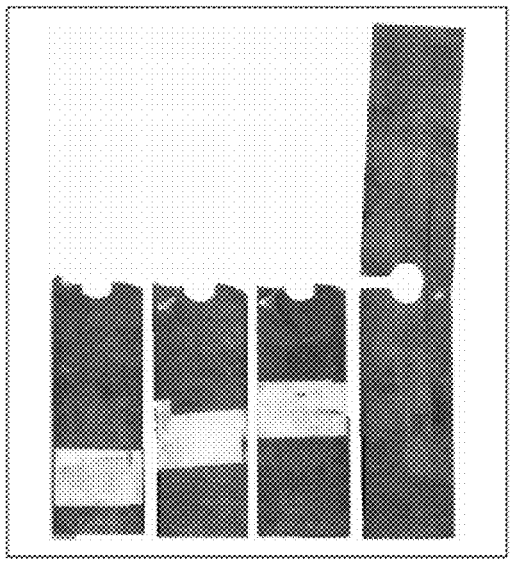
Figure 8C:
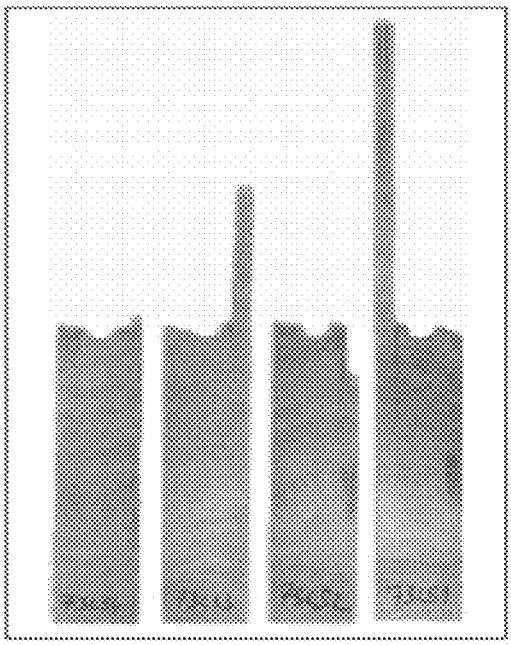
Figure 8D:
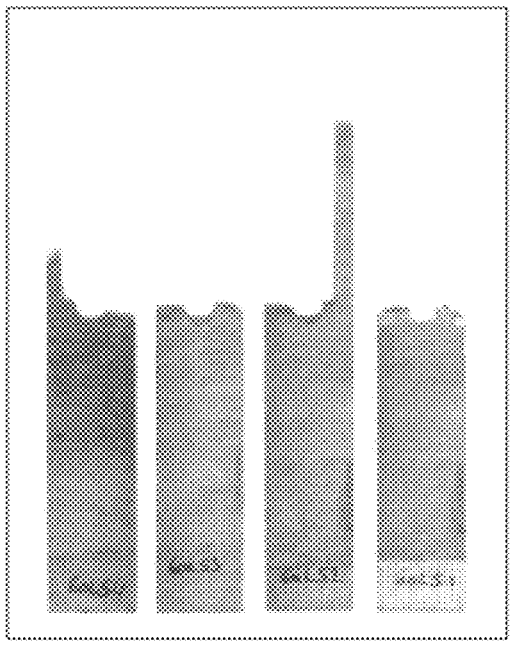

Plate A-60 exhibits a deviation angle Θ higher than 20° for $K_{eff\ max}$ of 10 MPa √m which shows that it has a low propensity to crack branching. This result was further confirmed by L-S fatigue trials. Four L-S samples according to FIG. 6 were taken in plate A-60 and plate B-60 and submitted to a fatigue trial (σmax=220 MPa, R=0.1) in mode I. FIG. 7*a* and FIG. 7*b* show, respectively, the four samples from plates A and B after fatigue trial. The results are consistent with those obtained through mixed mode I and mode II trials on S-L samples: all the samples from plate B-60 exhibit severe crack branching whereas samples from plate A-60 show only mode I crack propagation.

Example 2

Two AA2050 ingots, referenced A' and B and two AA2195 ingots referenced D and E were cast. Their composition is provided in Table 5.

TABLE 5

Composition (wt. %) of the different ingots

| | Si | Fe | Cu | Mn | Mg | Ti | Zr | Li | Ag | Zn |
|---|---|---|---|---|---|---|---|---|---|---|
| A' | 0.03 | 0.04 | 3.46 | 0.39 | 0.4 | 0.02 | 0.10 | 0.88 | 0.39 | 0.02 |
| C | 0.02 | 0.05 | 3.56 | 0.41 | 0.35 | 0.03 | 0.09 | 0.93 | 0.37 | 0.02 |
| D | 0.03 | 0.04 | 4.2 | — | 0.4 | 0.02 | 0.11 | 1.06 | 0.35 | 0.02 |
| E | 0.03 | 0.06 | 4.3 | 0.3 | 0.4 | 0.02 | 0.12 | 1.17 | 0.35 | 0.01 |

Ingot A' was homogenized 12 hours at 505° C. (heating rate: 15° C./h, equivalent time at 500° C.:16.7 h), according to the invention. Ingot C (reference) was homogenized 8 hours at 500° C. followed by 36 hours at 530° C. (heating rate: 15° C./h, equivalent time at 500° C.:140 h). Ingot A' was hot rolled to a 30 mm thick plate and the hot rolling exit temperature was 466° C., the resulting plate was solution heat treated for 2 h at 505° C. (heating rate: 50° C./h, equivalent time at 500° C.:3.0 h) and cold water quenched. Ingot C was hot rolled to a 30 mm thick plate and the hot rolling exit temperature was 474° C., the resulting plate was solution heat treated for 5 h at 525° C. (heating rate: 50° C./h, equivalent time at 500° C.:15.7 h) and cold water quenched. Both plates were stretched with a permanent elongation of 3.5% and aged 18 hours at 155° C. The plates resulting from ingot A and ingot B are referred to as plate A'-30 and plate C-30, respectively.

Ingots D and E were homogenized 15 hours at 492° C. (heating rate: 15° C./h, equivalent time at 500° C.: 11.5 h). Ingot D was hot rolled to a 25 mm thick plate and the hot rolling exit temperature was 430° C., the resulting plate was solution heat treated for 5 h at 510° C. (heating rate: 50° C./h, equivalent time at 500° C.:8.4 h) and cold water quenched. Ingot E was hot rolled to a 30 mm thick plate and the hot rolling exit temperature was 411° C., the resulting plate was solution heat treated for 4.5 h at 510° C. (heating rate: 50° C./h, equivalent time at 500° C.:7.6 h) and cold water quenched. Both plates were stretched with a permanent elongation of 4.3% and aged 24 hours at 150° C. The plates resulting from ingot D and ingot E are referred to as plate D-25 and plate E-30, respectively. Total equivalent time at 773 K of homogenization and solution heat treatment t(eq) was thus 19.7 h, 155.7 h, 19.9 h et 19.1 h for plates A'-30, C-30, D-25 et E-30, respectively.

Fatigue trials on L-S samples were carried out on test samples from plates A'-30, C-30, D-25 and E-30. Four L-S samples according to FIG. 6 were taken in each plate and submitted to a fatigue trial (σmax=220 MPa, R=0.1) in mode I. FIGS. 8*a*, 8*b*, 8*c* and 8*d* show, respectively, the four samples from plates A'-30, C-30, D-25 and E-30 after fatigue trial. Samples form plate A'-30 do not show any crack branching whereas for samples from plates C-30, D-25 and E-30 at least one sample exhibit severe crack branching. The process according to the present invention, which combines a particular composition and defined homogenization and solution heat treatment conditions enables to obtain a plate free from crack branching A'-30, whereas this is not reached with plate C-30 (high homogenizing temperature), and plates D-25 and E-30 (high copper content).

What is claimed is:

1. A method for producing a substantially unrecrystallized aluminum alloy plate with a thickness of at least 30 mm and up to 60 mm, said method comprising:

a) casting an ingot comprising 2.2 to 3.9 wt. % Cu, 0.7 to 2.1 wt. % Li, 0.2 to 0.8 wt. % Mg, 0.2 to 0.5 wt. % Mn, 0.04 to 0.18 wt. % Zr, less than 0.05 wt. % Zn, and optionally 0.1 to 0.5 wt. % Ag, remainder aluminum and unavoidable impurities, b) homogenizing said ingot at 490°-510° C. for a duration from 4-15 hours, c) hot rolling said ingot with an exit temperature of at least 410° C. to a plate with a final thickness of at least 30 mm, d) solution heat treating by soaking at 490 to 540° C. for 15 min to 4 h, wherein the total equivalent time of homogenization and solution heat treatment t(eq)

$$t(eq) = \frac{\int \exp(-26100/T)dt}{\exp(-26100/T_{ref})}$$

does not exceed 30 h, where T (in Kelvin) is the instantaneous temperature of treatment, which evolves with the time t (in hours), and $T_{ref}$ is a reference temperature set at 773 K, e) cold water quenching, f) stretching said plate with a permanent set from 2 to 5%, g) aging said plate by heating at 130-160° C. for 5 to 60 hours.

2. A method according to claim 1 wherein Li+Cu>4 wt. %.

3. A method according to claim 1 wherein Li+0.7 Cu<4.3.

4. A method according to claim 1 wherein the lithium content is from 0.8 to 1.8 wt. %.

5. A method according to claim 1 wherein the lithium content is from 0.9 to 1.4 wt. %.

6. A method according to claim 1 wherein the copper content is from 2.7 to 3.9 wt. %.

7. A method according to claim 6 wherein the copper content is from 3.2 to 3.9 wt. %.

8. A method according to claim 1 wherein the manganese content is from 0.3 to 0.5 wt. %.

9. A method according to claim 1 wherein said hot rolling exit temperature is at least 430° C.

10. A method according to claim 1 wherein said aging is done by heating at 140-160° C. from 12 to 50 hours.

11. A method for producing a substantially unrecrystallized aluminum alloy plate with a thickness of at least 30 mm and up to 60 mm, said method comprising:

a) casting an ingot comprising 2.2 to 3.9 wt.% Cu, 0.7 to 2.1 wt. % Li, 0.2 to 0.8 wt. % Mg, 0.2 to 0.5 wt. % Mn, 0.04 to 0.18 wt. % Zr, less than 0.05 wt. % Zn, and optionally 0.1 to 0.5 wt. % Ag, remainder aluminum and unavoidable impurities, and wherein Li+Cu>4.3 wt. %, b) homogenizing said ingot at 505-510° C. for a duration from 4-15 hours, c) hot rolling said ingot with an exit temperature of at least 410° C. to a plate with a final thickness of at least 30 mm, d) solution heat treating by soaking at 490 to 540° C. for 15 min to 4 h, wherein the total equivalent time of homogenization and solution heat treatment t(eq)

$$t(eq) = \frac{\int \exp(-26100/T)dt}{\exp(-26100/T_{ref})}$$

does not exceed 30 h, where T (in Kelvin) is the instantaneous temperature of treatment, which evolves with the time t (in hours), and $T_{ref}$ is a reference temperature set at 773 K, e) cold water quenching, f) stretching said plate with a permanent set from 2 to 5%, g) aging said plate by heating at 130-160° C. for 5 to 60 hours.

12. The method of claim 1, wherein the method results in a substantially unrecrystallized aluminum alloy plate having a low propensity to crack branching.

13. The method of claim 12, wherein the substantially unrecrystallized aluminum alloy plate has a deviation angle Θ value of at least 20° for a $K_{eff\ max}$ =10 mPa √m for a Sinclair sample under mixed-mode load (Ψ=75° ).

14. The method of claim 13, wherein the substantially unrecrystallized aluminum alloy plate has a deviation angle Θ value of at least 30° for a $K_{eff\ max}$ =10 mPa √m for a Sinclair sample under mixed-mode load (Ψ=75° ).

15. The method of claim 11, wherein the method results in a substantially unrecrystallized aluminum alloy plate having a low propensity to crack branching.

16. The method of claim 15, wherein the substantially unrecrystallized aluminum alloy plate has a deviation angle Θ value of at least 20° for a $K_{eff\ max}$ =10 mPa √m for a Sinclair sample under mixed-mode load (Ψ=75° ).

17. The method of claim 15, wherein the substantially unrecrystallized aluminum alloy plate has a deviation angle Θ value of at least 30° for a $K_{eff\ max}$ =10 mPa √m for a Sinclair sample under mixed-mode load (Ψ=75° ).

* * * * *